US008010370B2

(12) United States Patent
Baumgarte

(10) Patent No.: US 8,010,370 B2
(45) Date of Patent: Aug. 30, 2011

(54) BITRATE CONTROL FOR PERCEPTUAL CODING

(75) Inventor: Frank M. Baumgarte, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1432 days.

(21) Appl. No.: 11/495,207

(22) Filed: Jul. 28, 2006

(65) Prior Publication Data

US 2008/0027732 A1 Jan. 31, 2008

(51) Int. Cl.
*G10L 19/00* (2006.01)

(52) U.S. Cl. ..... 704/500; 704/208; 704/501; 704/502; 704/503; 704/504

(58) Field of Classification Search ..... None
See application file for complete search history.

(56) References Cited

U.S. PATENT DOCUMENTS

| | | | | |
|---|---|---|---|---|
| 6,499,010 | B1 * | 12/2002 | Faller | 704/229 |
| 7,003,449 | B1 | 2/2006 | Absar et al. | |
| 7,346,514 | B2 | 3/2008 | Herre et al. | |
| 2002/0146984 | A1 | 10/2002 | Suenaga | |
| 2003/0079222 | A1 * | 4/2003 | Boykin et al. | 725/31 |
| 2003/0088400 | A1 | 5/2003 | Nishio et al. | |
| 2003/0091194 | A1 | 5/2003 | Teichmann et al. | |
| 2004/0131204 | A1 * | 7/2004 | Vinton | 381/98 |
| 2004/0181394 | A1 | 9/2004 | Kim et al. | |
| 2004/0196913 | A1 * | 10/2004 | Chakravarthy et al. | 375/254 |
| 2005/0267744 | A1 | 12/2005 | Nettre et al. | |

OTHER PUBLICATIONS

Brandenburg, Karlheinz, "MP3 and\ AAC Explained" AES 17th International Conference on High Quality Audio Coding, pp. 1-12.
Dimkovic, Ivan, "Improved ISO AAC Coder" PsyTEL Research, Belgrade, Yogoslavia, 7 pages.

* cited by examiner

*Primary Examiner* — Leonard Saint Cyr
(74) *Attorney, Agent, or Firm* — Hickman Palermo Truong & Becker LLP; Daniel D. Ledesma

(57) ABSTRACT

Techniques for generating a target digital media item based on a source digital media item are described. A digital media item may be a song, a video clip, an album, or any length of audio or video. When adjusting the bit count for a portion of the target digital media item, instead of using the same set of parameter values used in a perceptual model for each portion of the source media item, the set of parameter values may be modified to encode the portion of the source digital media item. In this way, how audio or video is perceived is taken into account when adjusting a proposed bit count for a given portion of the target digital media item. Thus, while maintaining the same statistical bitrate as before increased digital media quality is achieved.

27 Claims, 4 Drawing Sheets

BITRATE CONTROL FOR PERCEPTUAL CODING

CROSS-REFERENCE TO RELATED APPLICATIONS

This application is related to U.S. patent application Ser. No. 11/495,073 filed Jul. 28, 2006, entitled "Determining Scale Factor Values in Encoding Audio Data with AAC"; the entire contents of which is incorporated by this reference for all purposes as if fully disclosed herein.

FIELD OF THE INVENTION

The present invention relates generally to digital media processing and, more specifically, to controlling bitrate by accounting for human perception

BACKGROUND

The approaches described in this section are approaches that could be pursued, but not necessarily approaches that have been previously conceived or pursued. Therefore, unless otherwise indicated, it is not to be assumed that any of the approaches described in this section qualify as prior art, merely by virtue of their inclusion in this section.

Digital media coding, or digital media compression, algorithms are used to obtain compact digital representations of high-fidelity (i.e., wideband) signals for the purpose of efficient transmission and/or storage. A central objective in (e.g. audio) coding is to represent the signal with a minimum number of bits while achieving transparent signal reproduction, i.e., while generating output digital media which cannot be humanly distinguished from the original input, even by a sensitive listener.

Advanced Audio Coding ("AAC") is a wideband audio coding algorithm that exploits two primary coding strategies to dramatically reduce the amount of data needed to convey high-quality digital audio. Signal components that are "perceptually irrelevant" and can be discarded without a perceived loss of audio quality are removed. Further, redundancies in the coded audio signal are eliminated. Hence, efficient audio compression is achieved by a variety of perceptual audio coding and data compression tools, which are combined in the MPEG-4 AAC specification. The MPEG-4 AAC standard incorporates MPEG-2 AAC, forming the basis of the MPEG-4 audio compression technology for data rates above 32 kbps per channel. Additional tools increase the effectiveness of AAC at lower bit rates, and add scalability or error resilience characteristics. These additional tools extend AAC into its MPEG-4 incarnation (ISO/IEC 14496-3, Subpart 4).

AAC is referred to as a perceptual audio coder, or lossy coder, because it is based on a listener perceptual model, i.e., what a listener can actually hear, or perceive. A common problem in perceptual audio coding is bitrate control. According to the concept of Perceptual Entropy, the information content of an audio signal varies dependent on the signal properties. Thus, the required bitrate to encode this information generally varies over time. For some applications bitrate variations are not an issue. However, for many applications a firm control of the instantaneous and/or average bitrate is desired.

The three basic bitrate modes for audio coding are CBR (constant bitrate), ABR (average bitrate) and VBR (variable bitrate). CBR is important to bitrate-critical applications, such as audio streaming. Unlike CBR, in which bitrates are strictly constant at each instance, ABR allows a variation of bitrates for each instance while maintaining a certain average bitrate for the entire track, thereby resulting in a reasonably predictable size to the finished files. Although VBR allows the bitrate to vary significantly, the sound quality is consistent.

A CBR codec is constant in bitrate along an audio time signal, but is typically variable in sound quality. For example, for stereo encoding at a bitrate of 96 kb/s, an encoded speech track, which is "easy" to encode due to its relatively narrow frequency bandwidth, sounds indistinguishable from the original source of the track. However, noticeable artifacts could be heard in similarly encoded complex classical music, which is "difficult" to encode due to a typically broad frequency bandwidth and, therefore, more data to encode.

Simultaneous Masking is a frequency domain phenomenon where a low level signal, e.g., a narrow-band noise (the maskee) can be made inaudible by a simultaneously occurring stronger signal (the masker). A masked threshold can be measured below which any signal will not be audible. The masked threshold depends on the sound pressure level (SPL) and the frequency of the masker, and on the characteristics of the masker and maskee. If the source signal consists of many simultaneous maskers, a global masked threshold can be computed that describes the threshold of just noticeable distortions as a function of frequency. The most common way of calculating the global masked threshold is based on the high resolution short term energy spectrum of the audio or speech signal.

Coding audio based on an audio perceptual model (i.e. psychoacoustic model) encodes audio signals above a masked threshold block by block. Therefore, if distortion (typically referred to as quantization noise), which is inherent to an amplitude quantization process, is under the masked threshold, a typical human cannot hear the noise. A sound quality target is based on a subjective perceptual quality scale (e.g., from 0-5, with 5 being best quality). From an audio quality target on this perceptual quality scale, a noise profile, i.e., an offset from the applicable masked threshold, is determinable. This noise profile represents the level at which quantization noise can be masked, while achieving the desired quality target. From the noise profile, appropriate quantization step sizes are determinable. The quantization step sizes are a significant determining factor of the coding bitrate.

After a block of audio data has been encoded, a bit count for that block of audio data is determined. If the bit count is too high (i.e., given the particular CBR or ABR target bitrate), then one way to reduce the bit count is to increase the quantization step sizes uniformly across all frequency bands of the block of audio data. Although this adjustment may effectively reduce the bit count, the adjustment does not take into account how audio is perceived differently at different frequencies. This may cause unacceptable noise to be generated at certain frequencies when the encoded audio is decoded and subsequently played.

Based on the foregoing, there is room for improvement in audio coding techniques.

In the foregoing description, AAC has been described as an example audio coding algorithm. However, embodiments of the invention are not limited to AAC. Any audio or video coding algorithm that employs a perceptual model may be used, such as MP3, AC-3, and WMA.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
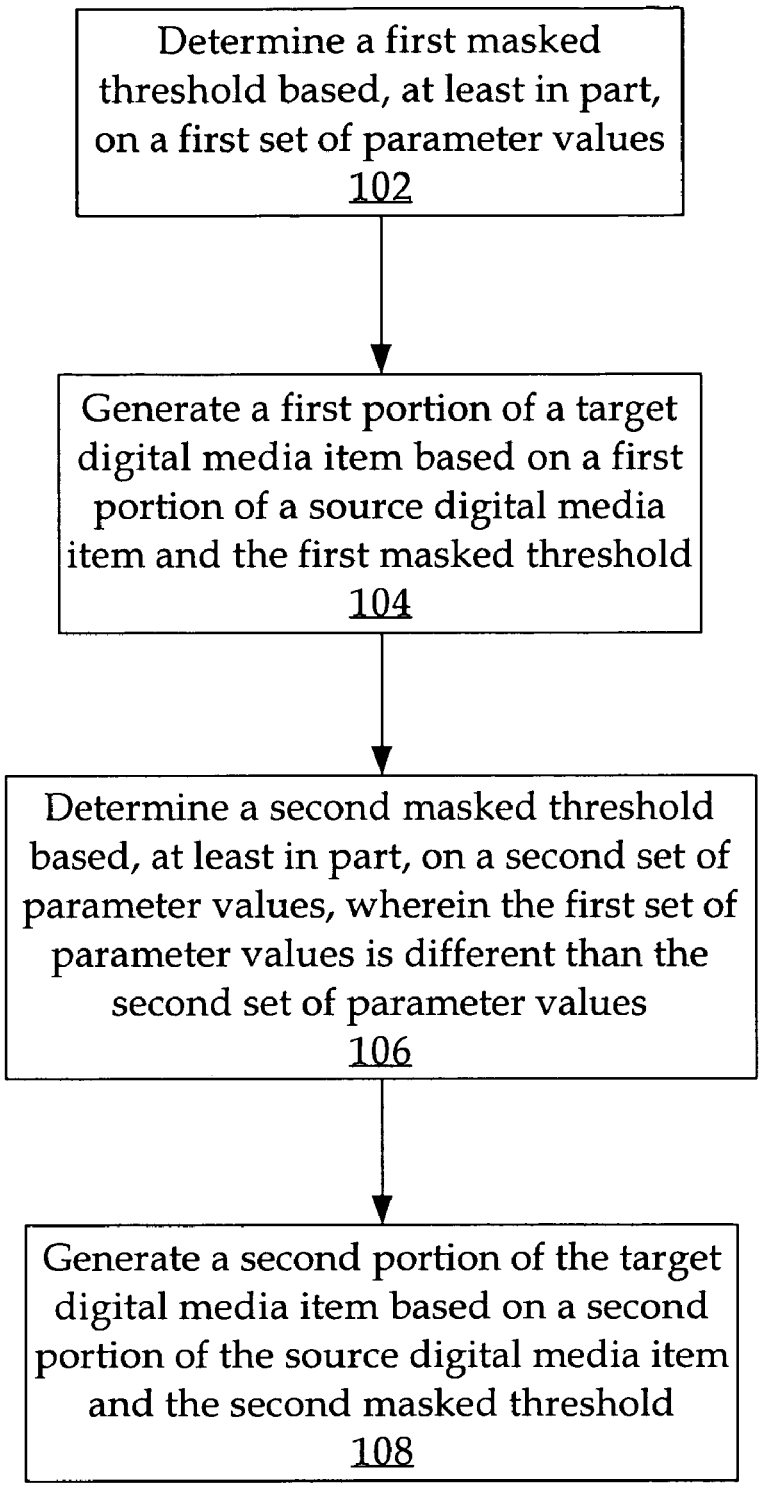
FIG. 1 is a flow diagram that illustrates how a target media item may be generated from a source media item, according to an embodiment of the invention.

The embodiments of the present invention described herein relate to a method for encoding digital media, such as digital audio and video. In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

General Overview

Perceptual digital media coding aims to achieve the best perceived digital media quality for a given target bitrate; or, conversely, perceptual digital media coding aims to achieve the lowest bitrate for a given quality target. The following encoder modules may be used to achieve these aims: a) a perceptual model that estimates a masked threshold based on a single set of parameter values, b) a bit allocation module that controls which parameters and spectral coefficients are transmitted and at which resolution, and c) a multiplexer that forms a valid bitstream. The following description is in the context of audio. However, embodiments of the invention are not limited to digital audio media, but rather are also applicable to digital video media.

Conceptually, a masked threshold indicates a maximum spectral level of quantization distortions that will be just inaudible. Audio coders have a bit allocation module designed to shape the quantization noise such that the quantization noise just approaches the masked threshold. This noise shaping is achieved by selecting "scale factors", each of which in turn determines the amount of quantization noise created in a "scale factor band" (SFB). As opposed to the traditional approach, this description introduces a new bitrate control approach that optimizes the scale factors based on a proposed bit count.

Traditionally, if the bit count of a particular block of data (hereinafter referred to as a "frame") is too high or too low, then each scale factor (there are typically 49 different scale factors for each frame) is uniformly increased or decreased, without modifying the values of the parameter set of the perceptual model. This results in a uniform increase or decrease of noise. However, it is desirable to increase or decrease noise non-uniformly because noise level change at certain frequencies may be less detectable by the human ear than the same amount of noise level change at other frequencies.

Thus, in one approach, if the bit count of a frame is too high or too low, then the values of the parameter set of the perceptual model are modified to take into account the fact that media is perceived differently at different (e.g., audio) frequencies. The perceptual model uses the new parameter values to generate new masked thresholds for each SFB.

In one approach, if the proposed bit count is not within a specified range, then the set of parameter values are modified and new masked thresholds are generated for the current frame. This process continues until the proposed bit count for the current frame is within the specified range. In another approach, if the bit count is not within the specified range, then, instead of generating new masked thresholds for the current frame, the modified set of parameter values are used to generate masked thresholds for the subsequent frame.

Functional Overview

FIG. 1 is a flow diagram that illustrates how a target media item may be generated from a source media item, according to an embodiment of the invention. In step 102, a first masked threshold is determined based, at least in part, on a first portion of a source digital media item and a first set of parameter values. In step 104, a first portion (e.g., a frame) of a target digital media item is generated based on the first portion of the source digital media item and the first masked threshold. In step 106, a second masked threshold is determined based, at least in part, on a second portion of the source digital media item a second set of parameter values. The first set of parameter values is different than the second set of parameter values. In step 108, a second portion of the target digital media item is generated based on the second portion of the source digital media item and the second masked threshold. Therefore, when encoding a media item, different sets of parameter values are used for different portions of the media item.

Traditional Bitrate Control

Figure 2:
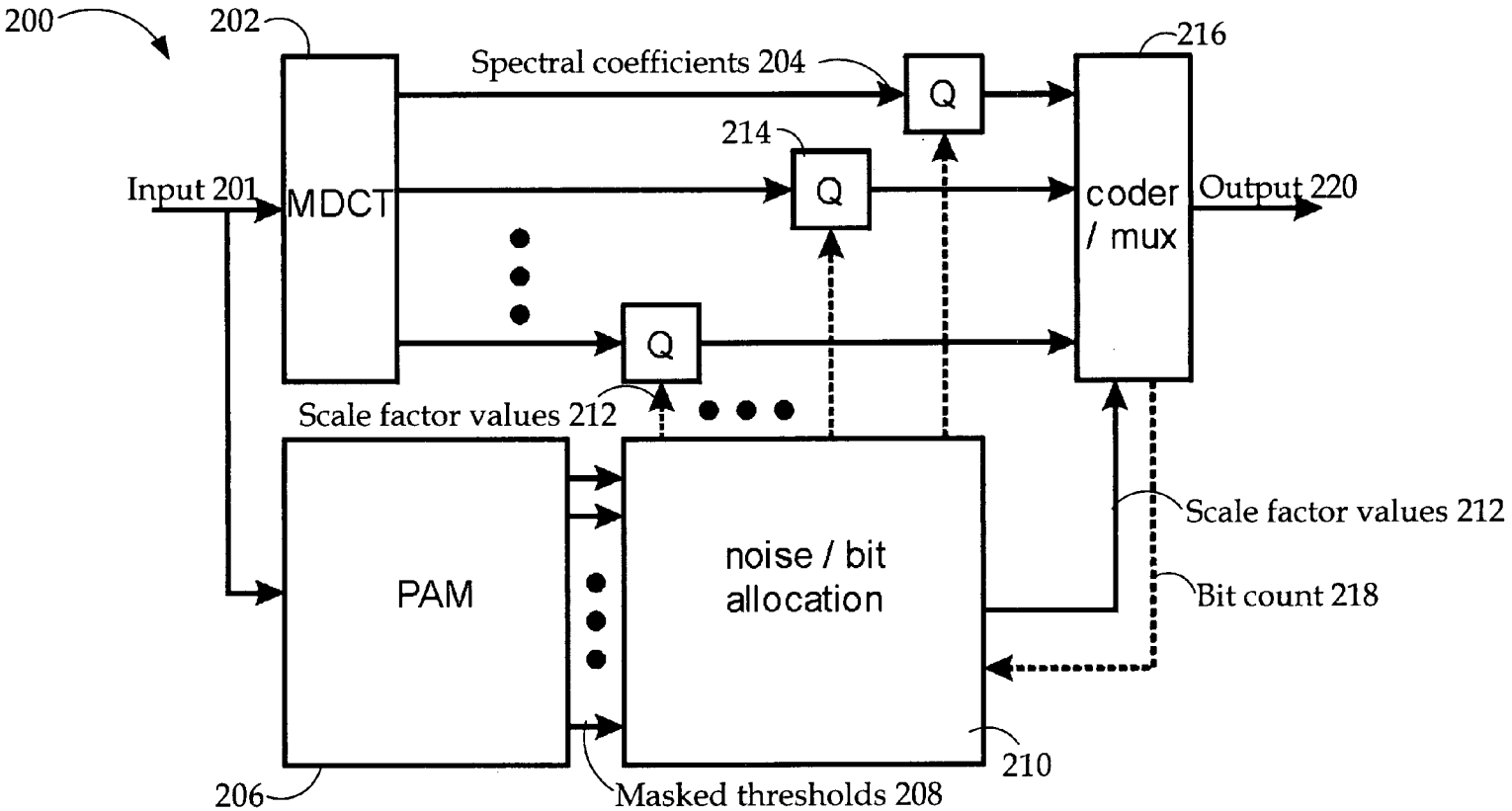
FIG. 2 is a block diagram that illustrates one type of bitrate control in a perceptual audio coder, according to an embodiment of the invention.

FIG. 2 is a block diagram that illustrates an example of a perceptual audio coder 200, according to an embodiment of the invention. Audio coder 200, which processes input 201, typically processes an audio signal in blocks of subsequent audio samples. For example, a typical block size comprises 1024 samples. Each block is referred to hereinafter as a "frame". A modified discrete cosine transform (MDCT) 202 is used to decompose the audio signal (e.g., input 201) into spectral coefficients 204, each one carrying a single frequency subband of the original signal. The MDCT input is typically comprised of two audio signal blocks, i.e. the previous block concatenated with the current block. The MDCT output represents the spectral content of a single frame. Filter banks other than an MDCT filter bank may also be used.

In addition to filter bank 202, input 201 is also received at a perceptual (e.g., psychoacoustic) model (PAM) 206. PAM 206 predicts masked thresholds 208 for quantization noise based on a fixed set of parameter values, such as frequency-dependent masked threshold offsets and parameters to control pre-echo suppression. A masked threshold 208 is the quantization noise level at which noise (resulting from quantizing certain spectral coefficients 204) is just inaudible. Each masked threshold 208 corresponds to a group of related spectral coefficients 204, called "scale factor bands" (SFBs). There are typically 49 different SFBs in a traditional audio perceptual coder to mimic the critical band model of the human auditory system. This means that if there are 1024 spectral coefficients, then the SFB representing the lowest frequency band comprises typically 4 spectral coefficients, and gradually a larger number of spectral coefficients are included in bands at higher frequencies.

As alluded to earlier, it is useful to isolate different frequency components in a signal because some frequencies are more important than others. Important frequency components should be coded with finer resolution because small differences at these frequencies are significant and a coding scheme that preserves these differences should be used. On the other hand, less important frequency components do not have to be exact, which means a coarser coding scheme may be used, even though some of the finer details will be lost in the coding. PAM 206 accounts for these differences in human auditory perception.

A noise/bit allocation module 210 calculates a scale factor value 212 for each SFB based on the corresponding masked threshold 208. In order to reduce the quantization noise level for each SFB, finer quantization must be used. With finer quantization, more bits are usually required to encode the quantized data.

Once scale factor values 212 are determined by noise/bit allocation module 210, spectral coefficients 204 of a given SFB are quantized by a quantizer 214 with the corresponding scale factor value 212. Any quantization scheme may be used, such as uniform and non-uniform quantization. The quantized values are encoded and multiplexed by a coder/mux module 216. FIG. 2 illustrates that scale factor values 212 (and/or the differences between scale factor values 212) are also encoded and multiplexed by coder/mux module 216. Any coding scheme may be used to encode the data, such as Huffman coding, and embodiments of the invention are not limited to any particular coding scheme.

The result of encoding and multiplexing all the foregoing data is examined (e.g., by noise/bit allocation module 210) to determine whether a bit count 218 of the result is within a specified range, depending on the target bitrate (whether under CBR mode or ABR mode). Bit count 218 represents a number of bits that may be used to encode input 201.

One way to lower bit count 218 (i.e., if bit count 218 is too high) is to increase each masked threshold level 208 by a constant value. If bit count 218 is too low, then each masked threshold level 208 is reduced by a constant value. As long as bit count 218 is outside the specified range, each masked threshold 208 is adjusted accordingly until bit count 218 is within the specified range. Once bit count 218 is within the specified range, then an output 220 is allowed to become part of the bitstream that represents the encoded data (e.g. song). Output 220, whose bit count 218 is within the specified range, is the encoded frame corresponding to input 201.

Increasing and decreasing each masked threshold level 208 by a constant amount, in order to adjust bit count 218, increases or decreases noise evenly. However, as mentioned previously, certain frequency components are more important than other frequency components. Thus, the more important frequency components should be treated differently than the less important frequency components. However, because all frequencies are currently treated the same when adjusting bit count 218, noise at some frequencies may be unnecessarily audible.

New Bitrate Control

Figure 3:
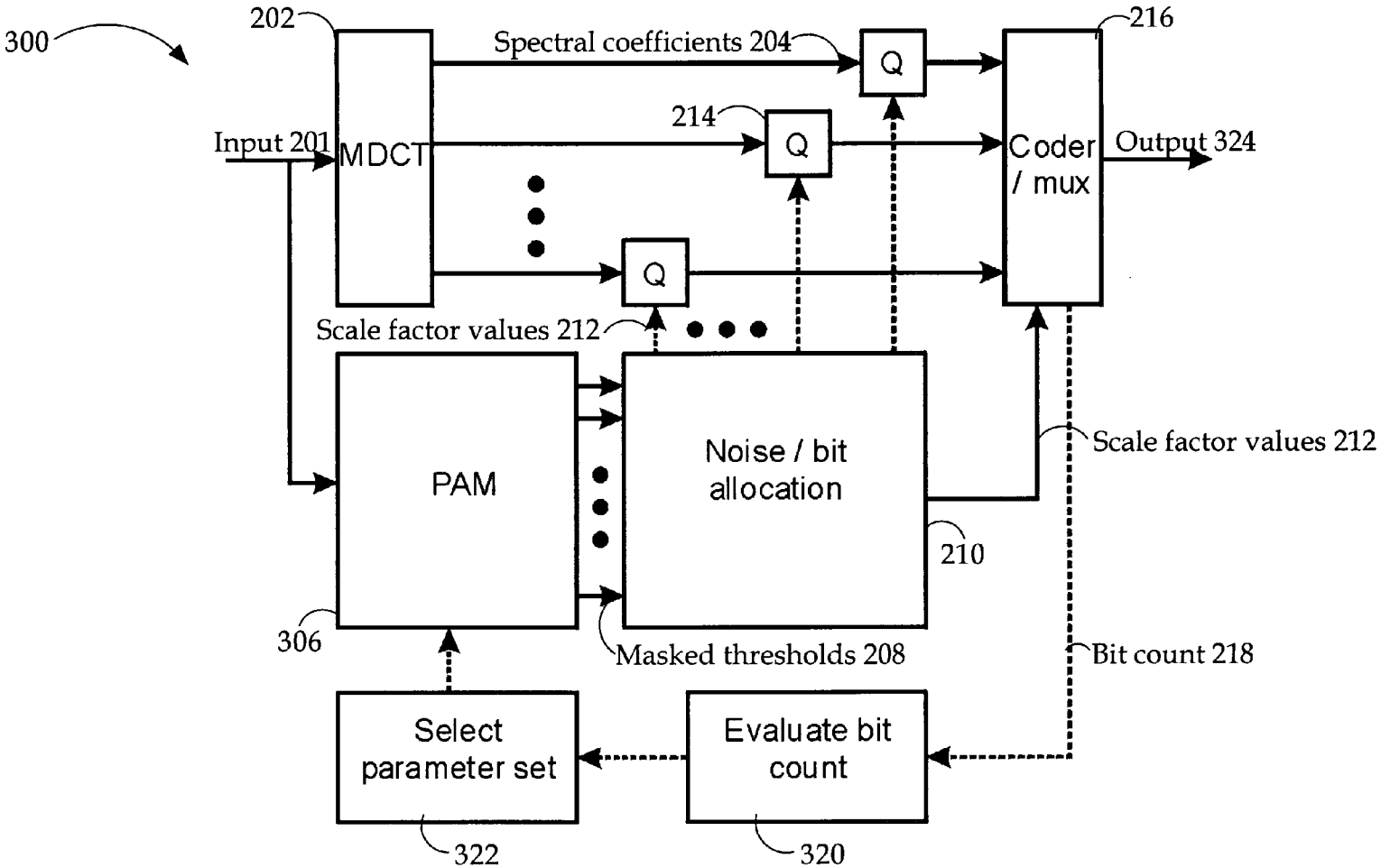
FIG. 3 is a block diagram that illustrates a perceptual audio coder with an improved bitrate control mechanism, according to an embodiment of the invention.

FIG. 3 is a block diagram that illustrates a perceptual coder 300 with an improved bitrate control mechanism, according to an embodiment of the invention. Much of the same modules and aspects illustrated in FIG. 2 are included in FIG. 3. For example, filter bank 202, noise/bit allocation module 210, quantizers 214, and coder/mux module 216 of FIG. 3 may be the same as the corresponding components illustrated in FIG. 2. A significant difference is the actions performed once the initial bit count 218 is determined.

In FIG. 3, items 320 and 322 may refer to additional modules of perceptual coder 300, and/or items 320 and 322 may refer to steps that are performed by one or more of the modules of coder 300, such as PAM 306 or coder/mux module 216. Hereinafter, items 320 and 322 will be referred to as modules.

Bit count evaluation module 320 evaluates bit count 218 to determine whether the short-term bit demand as indicated by the bit counts 218 from the current and past frames is in line with the target bitrate. If the short-term bit demand deviates from the target bit count by more than a given margin, then a different set of parameter values are selected (e.g., by parameter set selection module 322). In one embodiment, PAM 306 comprises bit count evaluation module 320 and parameter set selection module 322. Thus, PAM 306 may be tuned in a way to generate masked thresholds that lead on average to the desired target bitrate while retaining a desired level of audio quality.

By using PAM 306 again to generate new masked thresholds 208 for the current frame, bit count 218 may be lowered by reducing the number of bits currently allocated to encode the less important frequency components without significantly modifying the number of bits currently allocated to encode the more important frequency components. Thus, perceptual coder 300 may generate an output 324 that has the same bit count 218 as output 220 but with higher audio quality.

In one embodiment, the set of parameter values are modified for the current frame (i.e. input 201). Thus, the set of parameter values for a current frame may be modified for the current frame until bit count 218 for the current frame is within a specified range.

In one embodiment, to reduce computational complexity, the new set of parameter values may be applied beginning from the subsequent frame, so that the perceptual model calculations are only necessary once per frame. If the bit demand of the current frame still exceeds the limits due to CBR mode and/or ABR mode constraints, the perceptual coder 300 may fall back to the traditional method of bit count reduction by offsetting each masked threshold level 208 uniformly. However, due to PAM 306 parameter control, the impact of the traditional method is smaller and is used less frequently so that the overall audio quality increases over perceptual coder 200.

Determining when to Modify the Set of Parameter Values

According to one embodiment, a control mechanism for modifying the set of parameter values may be implemented as follows.

The following is a definition of appropriate variables, applicable to both CBR mode and ABR mode:

$b_n$: total bit count of frame n $\bar{b}_n$: sliding average bit count at frame n R: target bit count per frame δ: permissible target bit count deviation n: frame index (time)

i: parameter set index

α: forgetting factor the following may be calculated:

for the first frame (n=0):

$$\bar{b}_0=R$$

$$i=f(R)$$

and for the following frames:

$$\overline{b_n} = (1-\alpha)\overline{b_{n-1}} + \alpha b_n$$

$$i_n = \begin{cases} i_{n-1} - 1; & \text{if } \overline{b_n} > R(1+\delta) \\ i_{n-1} + 1; & \text{if } \overline{b_n} < R(1-\delta) \\ i_{n-1}; & \text{otherwise} \end{cases}$$

The average bit count $\overline{b}_n$ is initialized with the target bit count (R). The parameter set index i is initialized by finding the parameter set which has the closest average bit count with respect to the target bit count R. The average bit counts for each parameter set may be measured for a long audio sequence and stored in a table.

The bit count of each frame is averaged by a sliding window. The window parameter is the "forgetting" factor $\alpha$. A reasonable value for $\alpha$ is 0.01. When the average bit count deviates by more than a fraction of $\delta$ from the target bit count R, the parameter set is changed to adjust the bit count. As described above, the modified parameter set may be applied to the current frame to re-calculate the masked thresholds and bit allocation or they can be applied in a subsequent frame. The value of $\delta$ depends on the "spacing" of the parameter sets, i.e. how much the bit count is expected to change when the parameter set index is incremented or decremented. A reasonable value for $\delta$ is 0.2.

Bit Reservoir

In CBR mode, the bit count constraint may be relaxed if a bit reservoir is used. AAC employs a bit reservoir of limited size to support short-term fluctuations of the bit count per frame. If the bit reservoir is full, more bits may be allocated to a frame than the average number of bits per frame. Conversely, if the bit reservoir is empty, the maximum number of bits that can be allocated for the current frame is the average number of bits per frame. If the bit count is lower than a permitted range of bits, then fill bits may be used to maintain a constant bitrate average. If the bit demand is beyond the permitted range, the masked threshold level is shifted up or down to modify the bit count in the right direction which is the traditional method of bitrate control. Additionally, a short-term average of the initial bit count is calculated in order to detect when the average bit demand based on the perceptual model exceeds a margin around the target average bit count. In that case, the values of the parameter set of the psychoacoustic model are modified to adjust the bit demand.

In ABR mode, a constraint due to a bit reservoir is not necessary because the bit count may fluctuate significantly more than in CBR mode.

Parameters for Bitrate Control

Which parameters of the perceptual model are included in the parameter set depends on the specific perceptual model. In general, all parameters of the model may be included in the parameter set which are different for different target bitrates. For example, if the perceptual model of an encoder has been tuned for different target bitrates, there will be parameters that have different values for each of the target bitrates. Such parameters may be included in the parameter set whose values are modified for controlling the bitrate on a frame-by-frame basis.

For a standard perceptual model such as the ones described in the MPEG-AAC standard, the following parameters may be included in the parameter set: (a) frequency-dependent masked threshold offsets, and (b) parameters to control pre-echo suppression.

Hardware Overview

Figure 4:
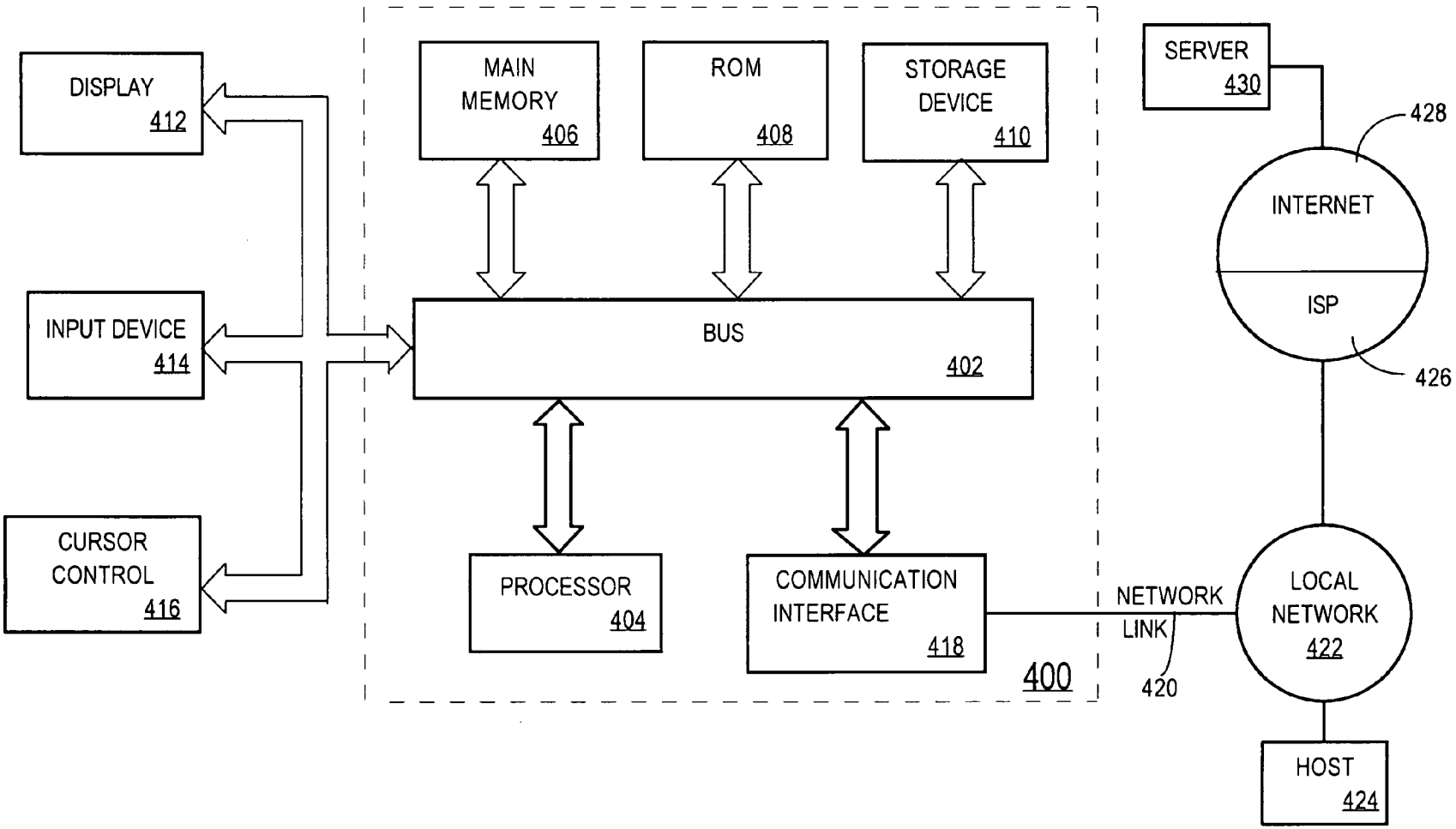
FIG. 4 is a block diagram that illustrates an exemplary computer system, upon which embodiments of the invention may be implemented.

FIG. 4 depicts an exemplary computer system 400, upon which embodiments of the present invention may be implemented. Computer system 400 includes a bus 402 or other communication mechanism for communicating information, and a processor 404 coupled with bus 402 for processing information. Computer system 400 also includes a main memory 406, such as a random access memory (RAM) or other dynamic storage device, coupled to bus 402 for storing information and instructions to be executed by processor 404. Main memory 406 also may be used for storing temporary variables or other intermediate information during execution of instructions to be executed by processor 404. Computer system 400 further includes a read only memory (ROM) 408 or other static storage device coupled to bus 402 for storing static information and instructions for processor 404. A storage device 410, such as a magnetic disk or optical disk, is provided and coupled to bus 402 for storing information and instructions.

Computer system 400 may be coupled via bus 402 to a display 412, such as a Liquid Crystal Display (LCD) panel, a cathode ray tube (CRT) or the like, for displaying information to a computer user. An input device 414, including alphanumeric and other keys, is coupled to bus 402 for communicating information and command selections to processor 404. Another type of user input device is cursor control 416, such as a mouse, a trackball, or cursor direction keys for communicating direction information and command selections to processor 404 and for controlling cursor movement on display 412. This input device typically has two degrees of freedom in two axes, a first axis (e.g., x) and a second axis (e.g., y), that allows the device to specify positions in a plane.

The exemplary embodiments of the invention are related to the use of computer system 400 for implementing the techniques described herein. According to one embodiment of the invention, those techniques are performed by computer system 400 in response to processor 404 executing one or more sequences of one or more instructions contained in main memory 406. Such instructions may be read into main memory 406 from another machine-readable medium, such as storage device 410. Execution of the sequences of instructions contained in main memory 406 causes processor 404 to perform the process steps described herein. In alternative embodiments, hard-wired circuitry may be used in place of or in combination with software instructions to implement the invention. Thus, embodiments of the invention are not limited to any specific combination of hardware circuitry and software.

The phrases "computer readable medium" and "machine-readable medium" as used herein refer to any medium that participates in providing data that causes a machine to operation in a specific fashion. In an embodiment implemented using computer system 400, various machine-readable media are involved, for example, in providing instructions to processor 404 for execution. Such a medium may take many forms, including but not limited to, non-volatile media, volatile media, and transmission media. Non-volatile media includes, for example, optical or magnetic disks, such as storage device 410. Volatile media includes dynamic memory, such as main memory 406. Transmission media includes coaxial cables, copper wire and fiber optics, including the wires that comprise bus 402. Transmission media can also take the form of acoustic or light waves, such as those generated during radio-wave and infra-red data communications. All such media must be tangible to enable the instructions carried by the media to be detected by a physical mechanism that reads the instructions into a machine.

Common forms of machine-readable media include, for example, a floppy disk, a flexible disk, hard disk, magnetic tape, or any other magnetic medium, a CD-ROM, any other optical medium, punchcards, papertape and other legacy media and/or any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 404 for execution. For example, the instructions may initially be carried on a magnetic disk of a remote computer. The remote computer can load the instructions into its dynamic memory and send the instructions over a telephone line using a modem. A modem local to computer system 400 can receive the data on the telephone line and use an infra-red transmitter to convert the data to an infra-red signal. An infra-red detector can receive the data carried in the infra-red signal and appropriate circuitry can place the data on bus 402. Bus 402 carries the data to main memory 406, from which processor 404 retrieves and executes the instructions. The instructions received by main memory 406 may optionally be stored on storage device 410 either before or after execution by processor 404.

Computer system 400 also includes a communication interface 418 coupled to bus 402. Communication interface 418 provides a two-way data communication coupling to a network link 420 that is connected to a local network 422. For example, communication interface 418 may be an integrated services digital network (ISDN) card or a modem to provide a data communication connection to a corresponding type of telephone line. As another example, communication interface 418 may be a local area network (LAN) card to provide a data communication connection to a compatible LAN. Wireless links may also be implemented. In any such implementation, communication interface 418 sends and receives electrical, electromagnetic or optical signals that carry digital data streams representing various types of information.

Network link 420 typically provides data communication through one or more networks to other data devices. For example, network link 420 may provide a connection through local network 422 to a host computer 424 or to data equipment operated by an Internet Service Provider (ISP) 426. ISP 426 in turn provides data communication services through the world wide packet data communication network now commonly referred to as the "Internet" 428. Local network 422 and Internet 428 both use electrical, electromagnetic or optical signals that carry digital data streams. The signals through the various networks and the signals on network link 420 and through communication interface 418, which carry the digital data to and from computer system 400, are exemplary forms of carrier waves transporting the information.

Computer system 400 can send messages and receive data, including program code, through the network(s), network link 420 and communication interface 418. In the Internet example, a server 430 might transmit a requested code for an application program through Internet 428, ISP 426, local network 422 and communication interface 418.

The received code may be executed by processor 404 as it is received, and/or stored in storage device 410, or other non-volatile storage for later execution. In this manner, computer system 400 may obtain application code in the form of a carrier wave.

Equivalents & Miscellaneous

In the foregoing specification, exemplary embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction and including their equivalents. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A machine-implemented method, comprising:

a perceptual model using a first set of parameter values for a particular set of input parameters;

the perceptual model generating, for a first scale factor band, a first masked threshold based at least in part on the first set of parameter values;

the perceptual model generating, for a second scale factor band that is different than the first scale factor band, a second masked threshold based at least in part on the first set of parameter values;

passing the first and second masked thresholds to a bit allocation unit;

the bit allocation unit generating a first scale factor value based on the first masked threshold and a second scale factor value based on the second masked threshold;

using the first and second scale factor values to encode a first portion of a digital media item in an encoding operation of the digital media item; and while performing said encoding operation, passing, to the perceptual model, a second set of parameter values for the particular set of input parameters;

the perceptual model generating, for the first scale factor band, a third masked threshold based at least in part on the second set of parameter values;

the perceptual model generating, for the second scale factor band, a fourth masked threshold based at least in part on the second set of parameter values;

wherein a difference between the third masked threshold and the first masked threshold is different than a difference between the fourth masked threshold and the second masked threshold;

passing the third and fourth masked thresholds to the bit allocation unit;

the bit allocation unit generating a third scale factor value based on the third masked threshold and a fourth scale factor value based on the fourth masked threshold;

using the third and fourth scale factor values to encode a second portion of the digital media item in the encoding operation of the digital media item;

wherein the first set of parameter values is different than the second set of parameter values;

wherein the method is performed by one or more computing devices.

2. The method of claim 1, further comprising:

examining a bit count of encoding said first portion;

determining that the bit count does not satisfy a particular set of criteria; and in response to determining that the bit count does not satisfy the particular set of criteria, encoding said first portion based, at least partially, on said second set of parameter values.

3. The method of claim 1, further comprising:

examining a bit count of encoding the first portion;

determining that the bit count does not satisfy a particular set of criteria; and in response to determining that the bit count does not satisfy the particular set of criteria, encoding said second portion based, at least in part, on the second set of parameter values;

wherein said second portion is immediately subsequent to said first portion.

4. A non-transitory machine-readable storage medium storing instructions which, when executed by one or more processors, cause:

a perceptual model using a first set of parameter values for a particular set of input parameters;

the perceptual model generating, for a first scale factor band, a first masked threshold based at least in part on the first set of parameter values;

the perceptual model generating, for a second scale factor band that is different than the first scale factor band, a second masked threshold based at least in part on the first set of parameter values;

passing the first and second masked thresholds to a bit allocation unit;

the bit allocation unit generating a first scale factor value based on the first masked threshold and a second scale factor value based on the second masked threshold;

using the first and second scale factor values to encode a first portion of a digital media item in an encoding operation of the digital media item; and while performing said encoding operation, passing, to the perceptual model, a second set of parameter values for the particular set of input parameters;

the perceptual model generating, for the first scale factor band, a third masked threshold based at least in part on the second set of parameter values;

the perceptual model generating, for the second scale factor band, a fourth masked threshold based at least in part on the second set of parameter values;

wherein a difference between the third masked threshold and the first masked threshold is different than a difference between the fourth masked threshold and the second masked threshold;

passing the third and fourth masked thresholds to the bit allocation unit;

the bit allocation unit generating a third scale factor value based on the third masked threshold and a fourth scale factor value based on the fourth masked threshold;

using the third and fourth scale factor values to encode a second portion of the digital media item in the encoding operation of the digital media item;

wherein the first set of parameter values is different than the second set of parameter values.

5. The machine-readable storage medium of claim 4, wherein said instructions, when executed by the one or more processors, further cause:

examining a bit count of encoding said first portion;

determining that the bit count does not satisfy a particular set of criteria; and in response to determining that the bit count does not satisfy the particular set of criteria, encoding said first portion based, at least partially, on said second set of parameter values.

6. The machine-readable storage medium of claim 4, wherein said instructions, when executed by the one or more processors, further cause:

examining a bit count of encoding the first portion;

determining that the bit count does not satisfy a particular set of criteria; and in response to determining that the bit count does not satisfy the particular set of criteria, encoding said second portion based, at least in part, on the second set of parameter values;

wherein said second portion is immediately subsequent to said first portion.

7. A machine-implemented method for generating a target digital media item based on a source digital media item, comprising:

determining, for a first scale factor band, a first masked threshold based, at least in part, on a first portion of said source digital media item and a first set of parameter values;

determining, for a second scale factor band that is different than the first scale factor band, a second masked threshold based, at least in part, on the first portion of said source digital media item and said first set of parameter values;

generating a first portion of the target digital media item based on said first portion of said source digital media item and said first and second masked thresholds;

determining, for the first scale factor band, a third masked threshold based, at least in part, on a second portion of said source digital media item and a second set of parameter values that are different than the first set of parameter values;

determining, for the second scale factor band, a fourth masked threshold based, at least in part, on the second portion of said source digital media item and said second set of parameter values; and wherein a difference between the third masked threshold and the first masked threshold is different than a difference between the fourth masked threshold and the second masked threshold;

generating a second portion of the target digital media item based on said second portion of said source digital media item and said third and fourth masked thresholds;

wherein the method is performed by a computing device.

8. The method of claim 7, wherein:

determining the first masked threshold includes passing said first set of parameter values to a perceptual model; and determining the third masked threshold includes passing said second set of parameter values to said perceptual model.

9. The method of claim 7, wherein:

the first masked threshold represents a threshold at which noise in said first portion of said source digital media item is substantially inaudible; and the third masked threshold represents a threshold at which noise in said second portion of said source digital media item is substantially inaudible.

10. The method of claim 7, further comprising:

examining a bit count of a certain portion of the target digital media item that is to be encoded based on the first set of parameter values;

determining that the bit count does not satisfy a particular set of criteria; and in response to determining that the bit count does not satisfy the particular set of criteria, encoding said certain portion based, at least partially, on the second set of parameter values.

11. The method of claim 7, wherein the second portion of the target digital item is subsequent to the first portion of the target digital item, further comprising:

examining a bit count of the first portion of the target digital media item that is encoded based on the first set of parameter values;

determining that the bit count does not satisfy a particular set of criteria; and in response to determining that the bit count does not satisfy the particular set of criteria, encoding said second portion of the target digital media item based, at least in part, on the second set of parameter values and the second portion of the source digital media item.

12. The method of claim 7, wherein generating a first portion of the target digital media item includes:

generating a scalefactor value based on said first masked threshold; and quantizing, based on said scalefactor value, a plurality of modified discrete cosine transform (MDCT) coefficients.

13. The method of claim 7, wherein a parameter in the particular set of input parameter includes at least one of the following: a frequency-dependent masked threshold offset or a parameter for pre-echo suppression.

14. A non-transitory machine-readable storage medium for generating a target digital media item based on a source digital media item, the machine-readable storage medium storing instructions which, when executed by one or more processors, cause:

determining, for a first scale factor band, a first masked threshold based, at least in part, on a first portion of said source digital media item and a first set of parameter values for a particular set of input parameters;

determining, for a second scale factor band that is different than the first scale factor band, a second masked threshold based, at least in part, on the first portion of said source digital media item and said first set of parameter values;

generating a first portion of the target digital media item based on said first portion of said source digital media item and said first and second masked thresholds;

determining, for the first scale factor band, a third masked threshold based, at least in part, on a second portion of said source digital media item and a second set of parameter values, that are different than the first set of parameter values, for the particular set of input parameters;

determining, for the second scale factor band, a fourth masked threshold based, at least in part, on the second portion of said source digital media item and said second set of parameter values; and wherein a difference between the third masked threshold and the first masked threshold is different than a difference between the fourth masked threshold and the second masked threshold;

generating a second portion of the target digital media item based on said second portion of said source digital media item and said third and fourth masked thresholds.

15. The machine-readable storage medium of claim 14, wherein:

determining the first masked threshold includes passing said first set of parameter values to a perceptual model; and determining the third masked threshold includes passing said second set of parameter values to said perceptual model.

16. The machine-readable storage medium of claim 14, wherein:

the first masked threshold represents a threshold at which noise in said first portion of said source digital media item is substantially inaudible; and the third masked threshold represents a threshold at which noise in said second portion of said source digital media item is substantially inaudible.

17. The machine-readable storage medium of claim 14, wherein said instructions, when executed by the one or more processors, further cause:

examining a bit count of a certain portion of the target digital media item that is to be encoded based on the first set of parameter values;

determining that the bit count does not satisfy a particular set of criteria; and in response to determining that the bit count does not satisfy the particular set of criteria, encoding said certain portion based, at least partially, on the second set of parameter values.

18. The machine-readable storage medium of claim 14, wherein said instructions, when executed by the one or more processors, further cause:

examining a bit count of the first portion of the target digital media item that was encoded based on the first set of parameter values;

determining that the bit count does not satisfy a particular set of criteria; and in response to determining that the bit count does not satisfy the particular set of criteria, encoding said second portion of the target digital media item based, at least in part, on the second set of parameter values and the second portion of the source digital media item.

19. The machine-readable storage medium of claim 14, wherein generating a first portion of the target digital media item includes:

generating a scalefactor value based on said first masked threshold; and quantizing, based on said scalefactor value, a plurality of modified discrete cosine transform (MDCT) coefficients.

20. The machine-readable storage medium of claim 14, wherein a parameter in the particular set of input parameter includes at least one of the following: a frequency-dependent masked threshold offset or a parameter for pre-echo suppression.

21. A system for generating a target digital media item based on a source digital media item, comprising:

one or more processors;

a memory coupled to said one or more processors;

one or more sequences of instructions which, when executed, cause said one or more processors to perform the steps of:

determining, for a first scale factor band, a first masked threshold based, at least in part, on a first portion of said source digital media item and a first set of parameter values for a particular set of input parameters;

determining, for a second scale factor band that is different than the first scale factor band, a second masked threshold based, at least in part, on the first portion of said source digital media item and said first set of parameter values;

generating a first portion of the target digital media item based on said first portion of said source digital media item and said first and second masked thresholds;

determining, for the first scale factor band, a third masked threshold based, at least in part, on a second portion of said source digital media item and a second set of parameter values, that are different than the first set of parameter values, for the particular set of input parameters;

determining, for the second scale factor band, a fourth masked threshold based, at least in part, on the second portion of said source digital media item and said second set of parameter values; and wherein a difference between the third masked threshold and the first masked threshold is different than a difference between the fourth masked threshold and the second masked threshold;

generating a second portion of the target digital media item based on said second portion of said source digital media item and said third and fourth masked thresholds.

22. The system of claim 21, wherein:

determining the first masked threshold includes passing said first set of parameter values to a perceptual model; and determining the third masked threshold includes passing said second set of parameter values to said perceptual model.

23. The system of claim 21, wherein:

the first masked threshold represents a threshold at which noise in said first portion of said source digital media item is substantially inaudible; and the third masked threshold represents a threshold at which noise in said second portion of said source digital media item is substantially inaudible.

24. The system of claim 21, wherein said instructions are instructions which, when executed by the one or more processors, further cause the one or more processors to perform the steps of:

examining a bit count of a certain portion of the target digital media item that is to be encoded based on the first set of parameter values;

determining that the bit count does not satisfy a particular set of criteria; and in response to determining that the bit count does not satisfy the particular set of criteria, encoding said certain portion based, at least partially, on the second set of parameter values.

25. The system of claim 21, wherein the second portion of the target digital item is subsequent to the first portion of the target digital item, wherein said instructions are instructions which, when executed by the one or more processors, further cause the one or more processors to perform the steps of:

examining a bit count of the first portion of the target digital media item that was encoded based on the first set of parameter values;

determining that the bit count does not satisfy a particular set of criteria; and in response to determining that the bit count does not satisfy the particular set of criteria, encoding said second portion of the target digital media item based, at least in part, on the second set of parameter values and the second portion of the source digital media item.

26. The system of claim 21, wherein generating a first portion of the target digital media item includes:

generating a scalefactor value based on said first masked threshold; and quantizing, based on said scalefactor value, a plurality of modified discrete cosine transform (MDCT) coefficients.

27. The system of claim 21, wherein a parameter in the particular set of input parameter includes at least one of the following: a frequency-dependent masked threshold offset or a parameter for pre-echo suppression.

* * * * *